US005435415A

United States Patent [19]

Kulak et al.

[11] Patent Number: 5,435,415

[45] Date of Patent: Jul. 25, 1995

[54] CAMMED WEDGE ELEVATOR CAR DOOR COUPLING

[75] Inventors: Richard E. Kulak, Bristol; Edward E. Ahigian, West Hartford; Thomas M. McHugh, Farmington; Jerome F. Jaminet, South Windsor; Thomas He, Unionville; Richard E. Peruggi, Glastonbury; Thomas M. Kowalczyk, Farmington; David W. Barrett, East Hartland, all of Conn.

[73] Assignee: Otis Elevator Company, Farmington, Conn.

[21] Appl. No.: 223,925

[22] Filed: Apr. 6, 1994

[51] Int. Cl.[6] ..... B66B 13/00

[52] U.S. Cl. ..... 187/330; 49/120

[58] Field of Search ..... 187/319, 330; 49/116, 49/120

[56] References Cited

U.S. PATENT DOCUMENTS 3,738,454 6/1973 Atkey ..... 187/330

4,108,283 8/1978 Mangel ..... 187/330

*Primary Examiner*—Kenneth Noland

[57] ABSTRACT

An elevator hoistway door is coupled to an elevator car door so as to be opened and closed in unison therewith by means of a pair of shoes which are mounted on the elevator door and have cammed surfaces that allow the shoes to be spread so as to be wedged within the walls of a channel that is mounted on the hoistway door. The wedging action is caused by a solenoid actuator and the shoes are returned by means of a spring to a rest position in which they have adequate clearance within channels of all of the hoistway doors which the elevator may pass. Advance door opening and releveling is accommodated by means of rollers or sliding contact.

8 Claims, 1 Drawing Sheet

CAMMED WEDGE ELEVATOR CAR DOOR COUPLING

TECHNICAL FIELD

This invention relates to positively coupling the hoistway doors of an elevator to the elevator car doors so that the hoistway doors can be driven open and driven closed, positively, in unison with and by the motion of the elevator car doors as they are driven open and driven closed by a door operating mechanism.

BACKGROUND ART

Modern elevator systems have doors to permit transfer of passengers between the elevator cars and the respective floor landings. Because smaller doors have to travel a lesser distance and have less inertia, many elevators have two doors. They may meet in the middle, and thereby have a lesser distance to travel or they may both travel to the same side for opening. Other elevators may have only a single door. As used herein, the term "door" or "doors" may be used interchangeably, it being understood that there is no distinction between a single door and double doors concerning the subject matter hereof.

Present day elevator systems have doors mounted on the elevator car, and doors mounted at each hall landing of the elevator hoistway. The hoistway doors at the hall landings are mounted directly to the building structure, and are kept closed whenever the car is not present at the related landing in order to prevent passengers and objects from entering the hoistway. Instead of having door operators for each of the hoistway doors, the hoistway doors are typically opened by coupling them with the car doors, so that opening of the car doors will open the landing doors in unison therewith, thereby protecting passengers in the car from the building structure and protecting passengers at the landing from the hoistway.

The manner of coupling the doors together must take into account several factors. The doors usually begin to open just before the car reaches the landing (such as 10 or 15 centimeters therefrom), resulting in relative vertical motion between the elevator door and the hoistway door as the elevator approaches the landing. A similar constraint is that the car may be releveled after the doors are open, which also requires permissible relative vertical motion between the car doors and the hoistway doors. The hoistway doors may easily be pushed open by the elevator doors, but they must also become closed, either by being pulled (or pushed) toward the closed position by the elevator doors, or by some biasing in the closed direction. Biasing in the closed direction may take the form of a spring, a weight or a spirator. However, any bias in the closed direction must be overcome by the force exerted by the elevator doors during the opening process. Similarly, any perturbations in the bias during the opening process will in turn provide perturbation in the control algorithm for the elevator door opening system. Therefore, it is deemed preferable to have the hoistway doors opened and closed by the elevator doors, without separate bias.

A typical coupling device employs a rigid vane mounted on the car door which engages a rotatable pawl from the hoistway door, the pawl having rollers thereon so that the vane can travel upwardly or downwardly while engaging the pawl. Typically, there may be some lost motion between the two doors; that is, the car door must begin to open before it engages the pawl, unlocking the hoistway door, and commencing to push the hoistway door, through the pawl, in the open direction. When closing, this requires an additional mechanism to be sure that the hoistway doors are fully latched before the car door motion stops (before the car doors are fully closed). In some assemblies, the rollers move into contact with the vane before motion, and in others, the vane is expanded to contact the rollers before any motion. However, devices of this type are wear and adjustment sensitive and require frequent adjustments and replacements over the life span of an elevator system.

Whenever there is a change in the amount of force required to move an elevator car door, either because of lost motion between it and a hoistway door, or because of a change in the mechanism leverage and the like, perturbations of the electrical control system which is providing the motive force for the car door opening mechanism can result. This in turn can cause vibrations and other mechanical perturbations thus resulting in additional wear and noise. In fact, for door control mechanisms which have closed velocity loop electrical control systems, horizontally stiff coupling is required throughout the full range of door motion. For door couplings which have lost motion, that is, the two door sets are de-coupled during some range (between 1 and 3 centimeters) of car door motion, the hoistway doors must rely on a weight closer (or other biasing device) to fully close the hall doors. And, in very tall buildings, door closing (particularly at the lobby) can be erratic due to hoistway air pressure (called "windage" or "chimney effect"), unless the hoistway doors are closed positively.

Another desired feature is that the edges of the hoistway doors be flush with the edges of the car doors, as a consequence of being opened completely in unison.

Of course, any coupling mechanism located on a particular hoistway door must have complete clearance, for all of the apparatus, including the corresponding parts of a coupling device which are mounted on the car doors, so that elevators that are simply passing by landings do not run the risk of contact with the hoistway door coupling devices.

DISCLOSURE OF INVENTION

Objects of the invention include provision of a horizontally stiff coupling between an elevator car door and a hoistway door which, however, allows relative vertical motion between the car door and the hall door when coupled, and which provides the coupling throughout the full range of door motion.

According to the present invention, a pair of shoes having camming surfaces and disposed on an elevator car door are forced apart by a solenoid actuator so as to become wedged between parallel vertical walls extending outwardly from an elevator hoistway door into the hoistways (such as sidewalls of a channel mounted on a hoistway door), at a landing where the elevator car is making a stop. The shoes slide readily within the channel, due to low friction slide surfaces or rollers thereon, thereby allowing advance door opening (commencing to open the door just before the elevator reaches the landing), and releveling of the elevator, even after the doors are fully open. The shoes may be guided during the horizontal wedging motion by means of pins sliding within slots. A spring may provide restoring force to draw the shoes back together after door operation is completed, thereby allowing sufficient clearance between the shoes and channels similarly disposed on all of the hoistway doors.

The invention is relatively simple and requires no adjustment; it can automatically compensate for a wide degree of wear before replacement is required, and can self-adjust for floor-to-floor variation in location of the vertical walls. The invention thereby provides a suitable, stiff coupling to permit use of sophisticated door opening mechanisms with quiet, aesthetically pleasing door operation.

Other objects, features and advantages of the present invention will become more apparent in the light of the following detailed description of exemplary embodiments thereof, as illustrated in the accompanying drawing.

BEST MODE FOR CARRYING OUT THE INVENTION

Figure 1:
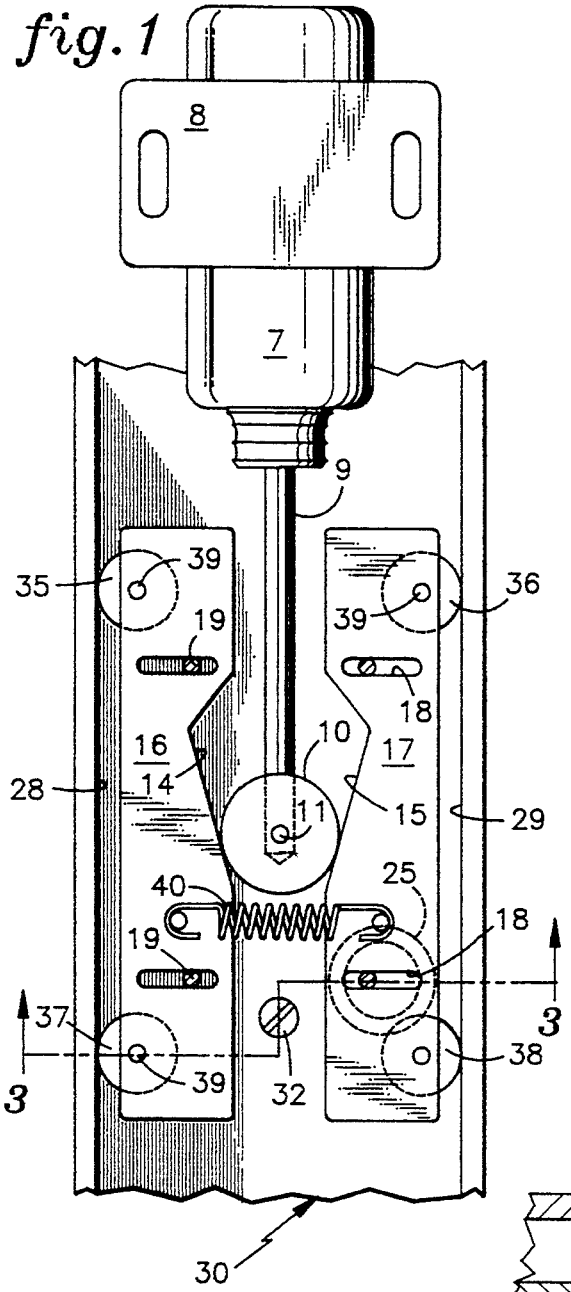
FIG. 1 is a partial, side elevation view of a door coupler in the wedged, or coupled position.
Figure 2:
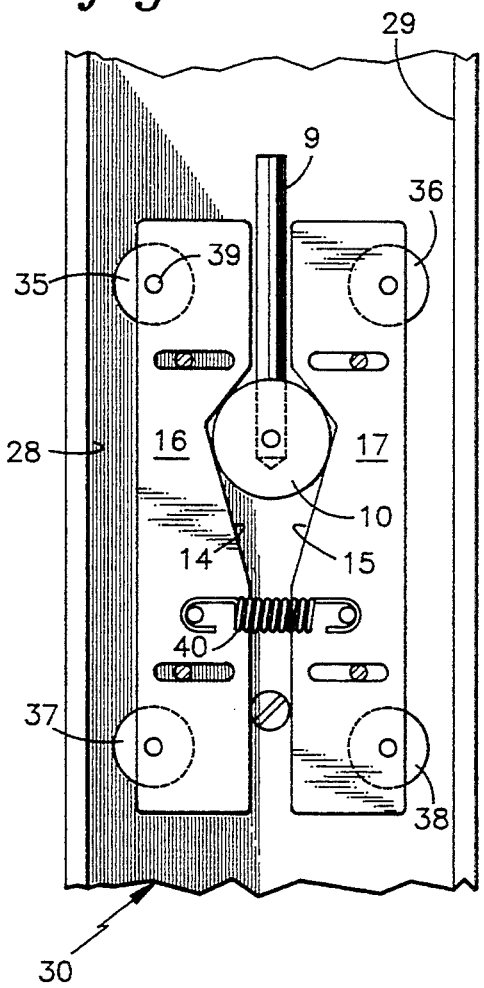
FIG. 2 is a partial, bottom, sectional view taken on the line 2—2 of FIG. 1.
Figure 3:
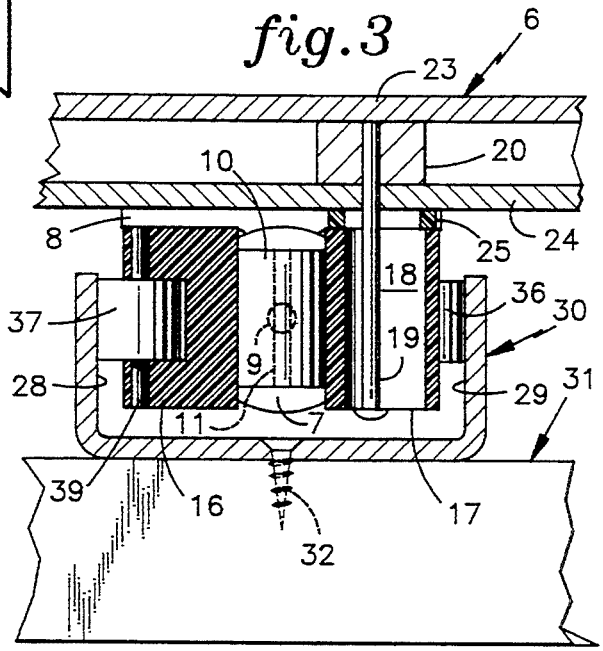
FIG. 3 is a partial, side elevation view of the door coupler in the retracted, or uncoupled position.

An elevator car door 6, shown in FIG. 2 but not in FIGS. 1 and 3, has a magnetic actuator 7 disposed thereon by means of a mounting plate 8. The actuator 7 has an armature 9 engaging a cylinder 10 into which it is disposed, and secured by a pin 11. As seen in FIG. 1, the cylinder 10 presses against camming surfaces 14, 15 of shoes 16, 17 which have slots 18 that allow the shoes 16 and 17 to slide horizontally on pins 19 that may be suitably secured to a frame member 20 of the elevator door 6. In this embodiment it is assumed that the elevator door 6 has an internal panel 23 and an external panel 24 disposed on a frame including the member 20. To facilitate horizontal sliding of the shoes 16 and 17, low friction plastic washers 25 or the like, only one of which is shown (dotted in FIG. 1), may be utilized if desired. As shown in FIGS. 1 and 2, the shoes 16, 17 have been forced outwardly into the coupling position, wedged between two outwardly extending surfaces 28, 29 of a channel member 30 which is disposed to a hoistway door 31 (shown only in FIG. 2) by means of a screw 32, or in any other suitable fashion, such as spot welding or other bonding. The shoes 16, 17 include cylinders 35–38 mounted on pins 39 disposed within the shoes 16, 17. The cylinders 35–38 may rotate about the pins, thus acting as rollers and facilitating relative vertical motion between the shoes 16, 17 and the channel 30, which is necessary during advance door opening and car releveling. On the other hand, the cylinders 35–38 need not necessarily rotate on the pins, but simply act as low friction bearing surfaces. If the shoes 16, 17 are formed from a low friction material such as teflon or delrin, they may have surfaces equivalent to those provided by the cylinders 36–38 formed integrally therewith (having the same silhouette as does the embodiment shown). Or, the shoes 16, 17 could be slightly wider and flat sided, allowing sliding contact between the entire sides thereof and the channel 30. However, the ability to rotate will result in less wear on the cylinders 35–38 than would occur on any sliding surface which does not rotate. The shoes 16, 17 may preferably be made of a sufficiently strong material so that myriad operations of the plunger 9 causing the cylinder 10 to act against the cammed surfaces 14, 15 will not cause impermissible wear in an unduly short period of time. The design shown herein, however, can accommodate a certain amount of wear, depending upon the detail of the cammed surface and cylinder 10, in an obvious way.

When door actuation is complete, and both sets of doors are fully closed, the plunger 9 is retracted (upwardly as seen in FIGS. 1 and 3) so as to return the cylinder 10 to the low point of the camming surfaces 14, 15 as seen in FIG. 3, thereby allowing a spring 40 to attract the two shoes 16, 17 into a retracted position in which the hoistway door 31 is uncoupled from the car door 6. When in the retracted position as shown in FIG. 3, there must be provided suitable clearance, such as 10–20 millimeters, between the shoes 16, 17 and the internal surfaces 28, 29 of the channel 30, so that as the car travels up and down past the landing, there is no interference between the shoes 16, 17, or any rollers 35–38 (or similar surfaces).

In the present embodiment, the camming surfaces 14, 15 are contacted by the cylinder 10 which acts as a cam operator. However, in place of the cylinder 10, two cylinders may be used, one at the front (as seen in FIG. 1) and one at the back of the armature 9, pivoted by the pin 11, to act as rollers, and thereby reduce wear. Or, in place of the cylinder 10, the cam operator may be a wedge, a cone, or a pyramid (or truncated versions of such shapes), or any other suitable shape. In the embodiment herein, there is only a single spring 40 shown, for clarity. However, another spring may be used in the vicinity of the rollers 35, 36, or if provision is made therefor, a spring or springs may be mounted on the back side (as seen in FIG. 1) of the shoes 16, 17.

Thus, although the invention has been shown and described with respect to exemplary embodiments thereof, it should be understood by those skilled in the art that the foregoing and various other changes, omissions and additions may be made therein and thereto, without departing from the spirit and scope of the invention.

We claim:

1. Apparatus for coupling an elevator hoistway door to an elevator car door so that the two may be operated in unison, comprising:

a pair of parallel vertical walls extending outwardly into the hoistway from a surface of a hoistway door;

a pair of shoes disposed to slide essentially horizontally adjacent a surface of an elevator door which is to be coupled with said hoistway door in a position relative to said walls so that each of said shoes may be forced against a corresponding one of said walls when the elevator is in the vicinity of the landing associated with said hoistway door, said shoes each having a camming surface facing the camming surface of the other one of said shoes; a first end of both of said camming surfaces being a first distance from each other and a second end of said camming surfaces being a distance from each other less than said first distance, so that said first ends of said camming surfaces are always a greater distance from each other than said second ends of said camming surfaces; and a solenoid actuator having an armature with a cam operator disposed at a distal end thereof, said actuator disposed on said elevator door in a position where it can force said cam operator from a point where it is in contact with said first ends of said camming surfaces to a point where it is in contact with said second ends of said camming surfaces, said solenoid actuator, when operated, moving said cam operator from said first ends of said camming surfaces to said second ends of said camming surfaces, thereby spreading said shoes apart from one another and causing said shoes to be wedged between said walls.

2. Apparatus according to claim 1 wherein each of said shoes has a pair of contact surfaces disposed thereon for contacting said walls when said shoes are wedged therebetween.

3. Apparatus according to claim 2 wherein said contact surfaces are on disks disposed to said shoes by pins.

4. Apparatus according to claim 3 wherein said contact surfaces are on rollers disposed to rotate about said pins.

5. Apparatus according to claim 1 further comprising:

a tension spring connected between said shoes for drawing said shoes tightly against said cam operator.

6. Apparatus according to claim 1 wherein said cam operator is disposed to the end of said armature.

7. Apparatus according to claim 1 wherein said cam operator is a disk.

8. Apparatus according to claim 1 wherein said shoes have slots, and slide along pins extending through said slots from said elevator door.

* * * * *